United States Patent [19]

Kanetake et al.

[11] 4,261,295

[45] Apr. 14, 1981

[54] RESTRAINING DEVICE FOR SMALL ANIMALS

[76] Inventors: Humie Kanetake; Asaharu Kanetake, both of Sunlight Mansion A, 1-311, 16, 1-chome, Nishiarai-honcho, Adachi-ku, Tokyo, Japan

[21] Appl. No.: 940,136

[22] Filed: Sep. 6, 1978

[30] Foreign Application Priority Data

Sep. 6, 1977 [JP] Japan ..... 52-107053

[51] Int. Cl.[3] ..... A61D 3/00

[52] U.S. Cl. ..... 119/103

[58] Field of Search ..... 119/103

[56] References Cited

U.S. PATENT DOCUMENTS

| | | | |
|---|---|---|---|
| 1,769,751 | 7/1930 | Oviatt | 119/103 |
| 3,286,694 | 11/1966 | Landy | 119/103 |
| 3,484,096 | 12/1969 | Briggs | 119/103 X |

FOREIGN PATENT DOCUMENTS

| | | | |
|---|---|---|---|
| 467728 | 5/1975 | U.S.S.R. | 119/103 |

*Primary Examiner*—Hugh R. Chamblee

*Attorney, Agent, or Firm*—Wenderoth, Lind & Ponack

[57] ABSTRACT

A restraining device for small animals which are used for animal experiments. The device has a pillow plate on a restraining plate which is easily adjustable on the restraining plate for placing the animals's head thereon. Further, two mouthpieces are mounted on the restraining plate for holding the animal's head, with the mouth open, on the restraining device.

3 Claims, 8 Drawing Figures

RESTRAINING DEVICE FOR SMALL ANIMALS

BACKGROUND OF THE INVENTION

The present invention is directed to a restraining device for use on small animals which are used for animal experiments and in particular for restraining small animals such as rats (white rats), mice (house mice), guinea pigs or rabbits.

These small animals, and rats in particular, are very quick and have sharp incisor teeth and claws so that there is a danger that a researcher may get bitten or scratched by the animal when drawing blood from or giving an injection to said animal. For this reason, animals such as these are not restrained on a restraining plate until they have been anesthetized after being held by two researchers who have thick gloves on. Moreover, restraining devices in the prior art are inadequate in that they have a tendency to move with the rat when the rat is recovering from a narcotic state and becomes unruly. This has made it necessary that operations be conducted with the rat in a syncopic state. However, because continuous anesthetization eventually causes the death of the rat, it has previously been impossible to dray blood from the animal when restrained on the prior art restraining devices, and the use thereof has been limited to animal experiments conducted when the animals are in an anesthetized state.

SUMMARY OF THE INVENTION

The drawbacks of prior art devices having already been described there is herewith disclosed a device of the kind shown in Japanese Utility Model Registration No. 1,109,713 which is directed to a restraining device for restraining small animals such as live rats in a manner such that they are restrained completely and are easily handled. However, the noted apparatus has disadvantages in that the adjustment of a pillow plate to an appropriate height is relatively difficult to accomplish and a movable arch-shaped mouth piece can be easily detached from its fixed state by the furious movement of the small animal. Further, a manual handle is located too close to the restraining portion holding the head of the animal.

An object of the present invention is to improve restraining devices such as that shown in Japanese Utility Model Registration No. 1,109,713.

Another object of the present invention is to provide restraining device which is simple in structure and insures the safe and secure holding of the head of small animals.

According to the present invention, these objects are accomplished by a combining of a movable mouth piece which is capable of being freely raised and lowered, and a leaf spring ascendingly sloped to the front of the apparatus for placing the head of small animal thereon.

BRIEF DESCRIPTION OF THE DRAWING

These and other objects and advantages of the present invention will become more apparent from the following description as shown by the accompanying drawings, wherein.

DETAILED DESCRIPTION OF PREFERRED EMBODIMENTS

Figure 1:
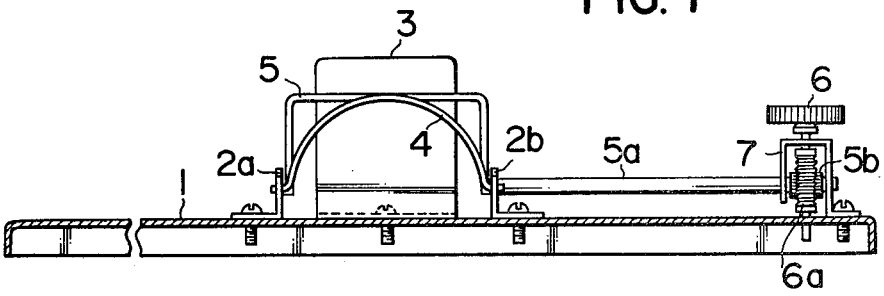
FIG. 1 is an elevational view of a restraining device for small animals according to the present invention, a portion of which is shown in cross section.
Figure 2:
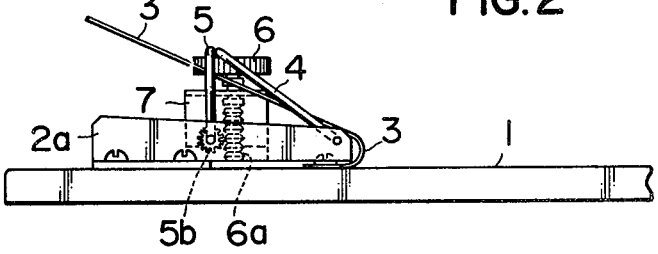
FIG. 2 is a left-side view of the restraining device of FIG. 1.
Figure 3:
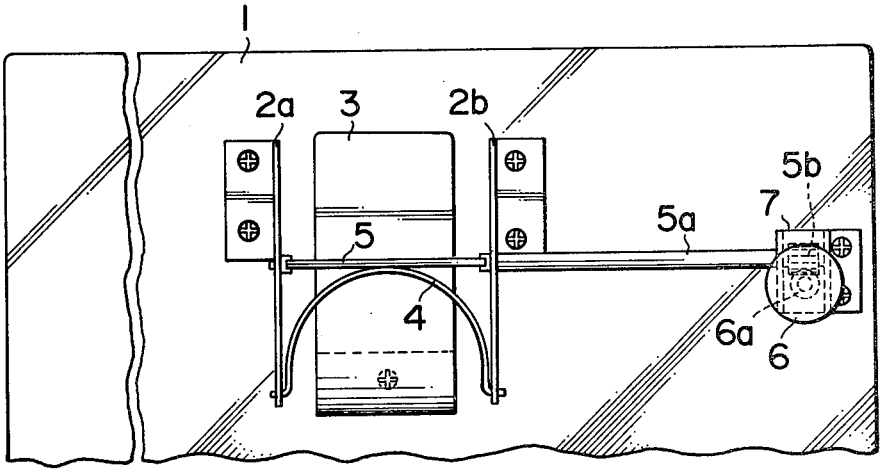
FIG. 3 is a plan view of the same.
Figure 4B:
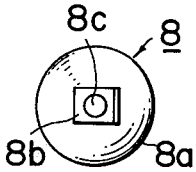
FIG. 4 is a view of a clamping means used in the restraining device shown in FIG. 1, in which (A) is an elevational view and (B) is a plan view thereof.
Figure 4A:
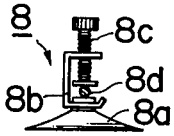
Figure 5:
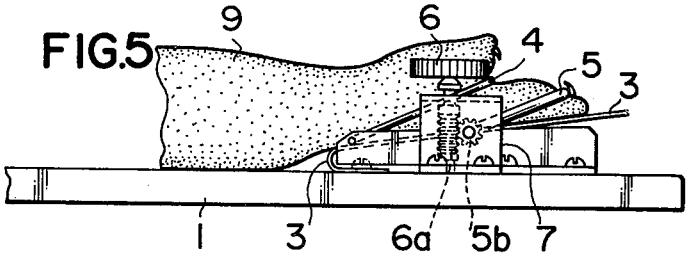
FIG. 5 is a right-side view showing the position in which the head portion of a small animal is held by the restraining device of FIG. 1.

Referring now to FIGS. 1 through 5, a restraining plate 1 is provided having a pair of side plates 2*a* and 2*b*, each of which has an L-shaped profile in the front half, such that the head portion of a small animal can be easily inserted in the space between the side plates 2*a* and 2*b*. A metal spring 3 is curved at an end portion so as that the other end ascendingly slopes toward the front, and the horizontal end portion is fixedly secured to the restraining plate 1 and functions as a pillow plate. An arch-shaped mouth piece 4 ascendingly slopes from the rear to the front and is fitted between the side plates 2*a* and 2*b* so as to be freely rotatably with respect to the side plates 2*a* and 2*b*. A further movable arch-shaped mouth piece 5 is disposed at the front of the first arch-shaped mouth piece 4 so that the second movable mouth piece 5 has its upper end portion in contact with the upper end portion of the first ascendingly sloped movable mouth piece 4 plate 1. An integral side portion to the second movable mouth piece 5 extends from one of the pair of side plates, such as side plate 2*b* and serves as shaft 5*a*. The shaft has at its end a worm gear apparatus which includes a gear 5*b* at the end of the shaft 5*a* which engages a screw gear 6*a* which is integral with a grip 6, said worm gear apparatus being supported by a frame 7. Accordingly, the second movable mouth piece 5 may be raised and lowered by the rotation of the grip 6. There is a clamping means 8 as shown in FIG. 4 for the limbs and tail of the small animal, which is comprised of a stick disc 8*a*, an approximately U-shaped frame 8*b* and a bolt 8*c*. The clamping means 8 may be attached to the restraining plate 1 at a suitable location according to size of the small animal 9, and the limbs and tail 8*d* of the small animal 9 are clamped down by the pressure being exerted by and between the lower end of the bolt 8*c* and the upper surface of the stick disc 8*a*.

In order to restrain a small animal such as, for example, a rat which has a great tendency to bite, on the restraining device of the present invention as described above, the rat is caught by its neck by means of one hand and laid on its back on the restraining plate, and at the same time the pillow plate of the leaf spring 3 is pushed downwardly at its upper end by the other hand, and then the head of the rat is placed between the leaf spring 3 and the movable mouth pieces 4 and 5 so as to clamp the mouth pieces 4 and 5 to the mouth of the rat. Thereafter, the leaf spring 3, when moved away from its normal rest position, presses upwardly on the occiput of the rat by means of its eleatic force, thus resulting in a pressing of the mouth of the rat between the leaf spring 3 and the mouth pieces 4 and 5. Because the movable mouth piece 5 contacts the mouth piece 4 when in the vertical state, both mouth pieces 4 and 5 can be inserted in the mouth of the rat without allowing the mouth of the rat to be opened to any great extent. After inserting the mouth pieces 4 and 5, the grip 6 is turned by one hand, the movable mouth piece 5 is slanted to the front towards the restraining plate 1 thus allowing the mouth of the rat to be widely open and thereby engage the movable mouth piece 5 with the incisor teeth therein. Accordingly, the head of the animal may be securely pressed onto the pillow plate of the leaf spring 3 by the pressure which is being applied to the spring 3 by the movable mouth piece 5 and the elastic force of the spring 3. It becomes apparent that because the movable piece 5 is raised and lowered by the worm gear means, it will not suddenly become loose and raised or lowered unless the grip 6 is turned, and that the occiput of the rat may be closely in contact with the leaf spring 3 at all times through the use of the pillow plate leaf spring 3, even if the rat acts in a furious manner and therefore, the head of the rat may be tightly held on the restraining plate 1. At this time, the rat can neither raise its neck because the cervical vertebrae of the rat are pressed rearwardly from the end of the upper jaw by the forwardly ascendingly inclined mouth piece 4, nor can it close its mouth because the jaw joint connecting the upper and lower jaws is also pressed down and the mouth is kept widely opened so that the rat cannot bite the worker. After the above described procedures are completed, the limbs and tail may be clamped by the clamping means 8 which is attached to the restraining plate 1 at any suitable location.

In another embodiment shown in FIS. 6 and 7, instead of having the leaf spring 3 of the pillow plate, the restraining device may include a restraining plate 11, a pair of side plates 12*a* and 12*b* which are mounted on one end portion of the restraining plate 11 and are each formed having slanted elongated holes 13, a moving lever 14 is position across the side plates 12*a* and 12*b*, both ends of which are inserted in the holes 13, a lever is located across the distance between the side plates 12*a* and 12*b* and at the rear ends thereof a pillow plate 16 which is curved at both of its ends extending between the front and rear levers 13 and 14, an approximately U-shaped frame 17 with both ends being rotatably pivotted with respect to the movable lever 14 outside of the holes 13, said frame 17 being connected to a supporting plate 18 by a bolt 19 and a nut 20, said bolt being an idler with respect to the supporting plate 18, and said nut 20 being secured to a guide flange 18' which is projectingly mounted on the supporting plate 18, whereby the rotation of the nut 20 permits the bolt 19 and the moving lever 14 to slide forwardly and rearwardly, and at the same time the moving lever 14 also slides within the elongated holes 13 and is raised and lowered at an angle so that accordingly, the tip of the pillow plate 16 can be adjusted and kept at any suitable height.

Having thus described preferred embodiment of the present invention, its advantages will now be apparent to those skilled in the art. According to the first embodiment shown in FIGS. 1 through 5, any small animal may be held at its head because of the simple structure which uses a leaf spring for a pillow plate on which the head of the small animal is laid without requiring adjustment of the height of the pillow plate. Moreover, the animal cannot bite because a gear means for raising and lowering movable mouth pieces is kept away from the portion where the head of animal is pressed and held by means of a shaft, and the accidental release of the mouth pieces can accordingly be prevented by the secure holding capabilities of the gear means.

Figure 6:
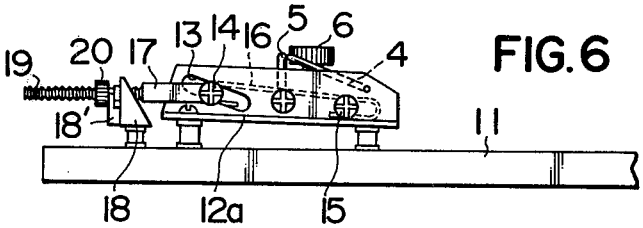
FIG. 6 is a left-side view of another embodiment of a restraining device for small animals according to the present invention.
Figure 7:
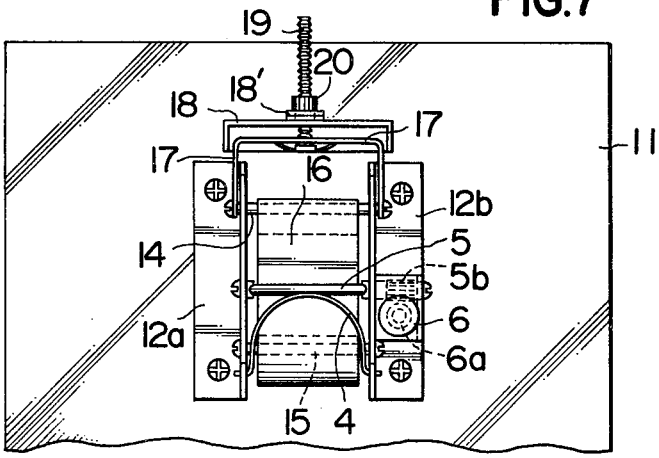
FIG. 7 is a right-side view of the restraining device of FIG. 6.

According to the second embodiment as shown in FIGS. 6 and 7, the height adjustment of the front end of the pillow plate may be easily and quickly made, and any small animal can be more securely held as compared to a device where the adjusting means for the height of the pillow is designed like the one disclosed in Japanese Utility Model Registration No. 1,109,713.

Accordingly, it should be understood that restraining devices for small animals be used to hold the animals safely and securely thereon by only one research person by an easy restraining manner without causing any lesions such as external injuries to the animals so that the animals can be kept alive for all animal experiments including experiments on the nervous system. Thus, it a great advantage of the present invention is that small animals, which have previously not been used for experiments because they could not be completely restrained, can now be used in all experiments in a live condition because such animals can now be completely restrained by the device of the present invention.

A last modification to the device is the addition of a motor which makes it possible to rotate the screw gear by said motor for raising and lowering the movable mouth piece.

What is claimed is:

1. A restraining apparatus for a small animal comprising: a restraining plate for holding said animal thereon; a pair of side plates mounted on said restraining plate at an end portion thereof at a space which is sufficient for placing the head of said animal thereon; a pillow plate disposed between said pair of side plates, said pillow plate being capable of adjusting the height at its end; a freely rotatably arch-shaped mouth piece provided at the rear ends of said pair of side plates and being sloped toward the front ends of said pair of side plates; a second rotatable arch-shaped mouth piece which is disposed so that it contacts the upper front surface of said sloped mouth piece when said arch-shaped mouth piece is rotated to a position which is vertical to said fixing plate; and a shaft extending from an end of said second mouth piece, said shaft being rotated by means of a gear mechanism for allowing said second mouth piece to raise and lower freely.

2. The restraining apparatus for a small animal as claimed in claim 1, wherein said pillow plate comprises a leaf spring which is mounted on said fixing plate between said pair of side plates so as to be ascendingly sloped to the front.

3. A restraining apparatus for a small animal as claimed in claim 1, wherein each one of said pair of said side plates mounted on said restraining plate has a slanted elongated hole located at the front end thereof said restraining device further comprising a mounting lever which is inserted into said slanted elongated holes; a lever which is disposed across the distance between said side plates at the rear ends thereof; said pillow plate extending between said front and rear levers; and means for adjusting the front end of said pillow plate at a desired height by advancing or drawing back said moving lever inserted into said holes.

* * * * *